US008069808B1

(12) United States Patent
Imlach et al.

(10) Patent No.: US 8,069,808 B1
(45) Date of Patent: Dec. 6, 2011

(54) BUOYANCY CONTROL SYSTEMS AND METHODS FOR SUBMERSIBLE OBJECTS

(75) Inventors: Joseph Imlach, Anchorage, AK (US); Paul J. Farley, Sequim, WA (US); Tracy D. DeVoll, Wasilla, AK (US)

(73) Assignee: Alaska Native Technologies, LLC, Anchorage, AK (US)

( * ) Notice: Subject to any disclaimer, the term of this patent is extended or adjusted under 35 U.S.C. 154(b) by 193 days.

(21) Appl. No.: 12/435,276

(22) Filed: May 4, 2009

Related U.S. Application Data

(63) Continuation-in-part of application No. 12/345,182, filed on Dec. 29, 2008, now Pat. No. 7,921,795.

(60) Provisional application No. 61/009,364, filed on Dec. 27, 2007.

(51) Int. Cl.
*B63G 8/14* (2006.01)

(52) U.S. Cl. ..... 114/331

(58) Field of Classification Search ..... 114/312, 114/313, 321, 326, 330–333
See application file for complete search history.

(56) References Cited

U.S. PATENT DOCUMENTS

| | | | | |
|---|---|---|---|---|
| 4,076,464 | A * | 2/1978 | Pinney | 417/332 |
| 4,898,288 | A * | 2/1990 | Erdbrink | 212/308 |
| 6,142,092 | A * | 11/2000 | Coupland | 114/331 |
| 6,371,041 | B1 * | 4/2002 | Ness | 114/333 |

OTHER PUBLICATIONS

Stommel, "The Slocum Mission", Oceanography, Apr. 1989, pp. 22-25.
Davis et al., "The Autonomous Lagrangian Circulation Explorer (ALACE)", Journal of Atmospheric and Oceanic Technology, vol. 9, 1992, pp. 264-285.
Eriksen et al., "Seaglider: A Long-Range Autonomous Underwater Vehicle for Oceanographic Research", IEEE Journal of Oceanic Engineering, vol. 26, No. 4, Oct. 2001, pp. 424-436.
Sherman et al., "The Autonomous Underwater Glider 'Spray'", IEEE Journal of Oceanic Engineering, vol. 26, No. 4, Oct. 2001, pp. 437-446.
Webb et al., "SLOCUM: An Underwater Glider Propelled by Environmental Energy", IEEE Journal of Oceanic Engineering, vol. 26, No. 4, Oct. 2001, pp. 447-452.

* cited by examiner

*Primary Examiner* — Daniel Venne
(74) *Attorney, Agent, or Firm* — Michael R. Schacht; Schacht Law Office, Inc.

(57) ABSTRACT

A buoyancy control system comprises a housing and first and second pistons movably supported by the housing. In a shallow mode, displacement of the first piston alters a buoyancy of the buoyancy control system. In a deep mode, displacement of the first and second pistons alters the buoyancy of the buoyancy control system.

31 Claims, 8 Drawing Sheets

BUOYANCY CONTROL SYSTEMS AND METHODS FOR SUBMERSIBLE OBJECTS

RELATED APPLICATIONS

This application is a continuation-in-part of pending U.S. patent application Ser. No. 12/345,182, filed Dec. 28, 2008.

U.S. patent application Ser. No. 12/345,182 claims benefit of U.S. Provisional Application Ser. No. 61/009,364, filed on Dec. 26, 2007. The contents of the related applications listed in this paragraph are incorporated herein by reference.

TECHNICAL FIELD

The present invention relates to systems and methods for controlling the buoyancy of waterborne objects and, more specifically, to buoyancy control systems and methods for controlling the buoyancy of devices and vehicles that are capable of being submersed.

BACKGROUND OF THE INVENTION

The ability to control the buoyancy of an object is desirable in many applications. For example, in the field of unmanned underwater vehicles (UUVs), it is often desirable to adjust the buoyancy of the vehicle to stabilize it in the water column (hover) or to make the vehicle rise or sink within the column.

Accordingly, many waterborne objects are provided with a buoyancy control mechanism, or "buoyancy engine", that allows active control of the buoyancy of the object. Active buoyancy control allows the buoyancy of an object to be adjusted as necessary for a desired maneuver or to accommodate unknown or changing environmental conditions. For example, the buoyancy of the object may be adjusted to bring a submerged object to the surface so that it can communicate via radio, then return the object to a submerged condition. As another example, the buoyancy of an object might be adjusted to accommodate variations in density of the surrounding water due to changes in temperature and/or salinity.

The present application is generally applicable to any type of waterborne object for which buoyancy control is desirable. Examples of waterborne objects that employ or may employ buoyancy control include: floats, buoys, weaponry (torpedoes), and manned and unmanned powered submarines. The present is invention is, however, of particular significance when applied to the class of UUV's referred to as "gliders". A glider is propelled through the water completely by changes to the buoyancy of the vehicle. The present invention will be described in detail below in the context of a glider.

For UUVs that are powered by batteries or other fixed energy storage mechanisms, one design goal is to optimize the energy efficiency of all onboard systems. The buoyancy control engine can be a major consumer of stored energy, so an effective buoyancy control engine should be energy efficient. The buoyancy engine should also be reliable, low weight, and easily maintainable.

Conventional gliders have a buoyancy engine that effectively changes the volume of the glider. One class of conventional gliders (e.g., the "Seaglider" produced by the University of Washington and the "Spray" produced by Bluefin Robotics) uses hydraulic pumps to transfer hydraulic fluid from an internal bladder to an external bladder. Yet another class of gliders (e.g., the "Slocum Thermal" produced by Webb Research) harvests the thermal energy of the ocean to move a transfer fluid between an internal bladder and an external bladder. The buoyancy engines employed by these gliders will be referred to as "internal bladder/external bladder" buoyancy control engines.

Another class of gliders (e.g., the "Slocum Electric" produced by Webb Research) uses a motor to drive a ball screw. The ball screw in turn drives a piston inside a rolling diaphragm. The diaphragm/piston combination displaces water when extended and ingests water when retracted. This type of buoyancy engine will be referred to as "ball screw/piston" type buoyancy control engines.

A related class of UUVs includes floats or buoys (e.g., The "ALACE" (Autonomous Lagrangian Circulation Explorer) floats). In the case of floats or buoys, the purpose of the buoyancy control system is typically to maintain neutral buoyancy for a period of time at a predetermined depth and then adjust the is buoyancy to cause the vessel to surface and communicate data. After the communication process is completed, the buoyancy of the vessel is again adjusted to cause the float or buoy to descend and then become neutrally buoyant at the predetermined depth. Such floats or buoys also use an "internal bladder/external bladder" configuration to control buoyancy.

One problem with the "internal bladder/external bladder" class of buoyancy engine is that a large amount of fluid is required to adjust the buoyancy of the device. Because the fluid is transferred into a bladder that directly displaces the water, there is a one to one ratio between required fluid and potential displacement (i.e. one liter of fluid is required to displace one liter of water). The ratio of required fluid to potential displacement limits the net buoyancy of the vehicle. In the context of gliders, this limitation on net buoyancy limits the speed of the glider and also the ability of the glider to adjust its buoyancy in response to changes in salinity and temperature.

Another disadvantage of the "internal bladder/external bladder" buoyancy engine is that the hydraulic pumps used in these designs are typically optimized for maximum efficiency at a significantly higher pressure than the operational pressure of the device. In particular, the hydraulic pump does not operate at maximum efficiency at the maximum operational depth of the vessel, and the hydraulic pump is even less efficient at shallower depths.

For example, the "Seaglider" glider developed by the University of Washington employs the Hydro LeDuc model PB32.5 pump. This pump has a maximum total efficiency (combined mechanical and volumetric efficiency) that peaks at approximately 34 MPa (~5000 psi), while the pressure at the Seaglider's maximum operational depth of approximately 1,000 m yields a pressure of approximately 10 MPa (~1500 psi). The efficiency of the buoyancy engine of the "Seaglider" glider is less than 15% at 200 m operation and only 40% at 1000 m operation.

The "ball screw/piston" type of buoyancy engine similarly suffers from low efficiency. Small DC motors are typically designed to run at high speeds (e.g. 5,000-10,000 rpm). While these motors can be highly efficient (typically 80-90%) at these relatively high operational speeds, the speed of such motors needs to be significantly reduced to drive a ball screw assembly of a "ball screw/piston" type buoyancy engine. A reduction gear is thus typically used to reduce the speed of the motor; a reduction gear is usually about 70% efficient, giving a combined efficiency in the range of 56-63%. In addition, the ball screw assembly itself typically operates at only about 95% efficiency, thereby reducing the maximum potential efficiency of this system to a range of 50-60%. The "Slocum Electric" device produced by Webb Research, which uses a ball screw/piston type buoyancy engine, has a published buoyancy engine efficiency of about 50%, which is at the low end of the theoretical range of efficiencies for the "ball screw/piston" type of buoyancy engine.

It is therefore an object of the current invention to provide buoyancy control systems and methods for a submersible vessel having improved efficiency over the entire operational depth range of the vessel. An additional object of the current invention is to provide buoyancy control systems and methods that are reliable and easy to manufacture and maintain.

SUMMARY

The present invention may be embodied as a buoyancy control system comprising a housing, a first piston, and a second piston. The first and second pistons are movably supported by the housing. In a shallow mode, displacement of the first piston alters a buoyancy of the buoyancy control system. In a deep mode, displacement of the first and second pistons alters the buoyancy of the buoyancy control system.

The present invention may also be embodied as a method of controlling buoyancy of a submersible object comprising the following steps. A housing is arranged within the submersible object. First and second pistons are movably supported relative to the housing. The first piston is displaced to alter a buoyancy of the submersible object in a first range of depths. The first and second pistons are displaced to alter a buoyancy of the submersible object in a second range of depths.

The present invention may also be embodied as a buoyancy control system for a submersible object comprising a housing and first second pistons. The housing is fixed relative to the submersible object. The first and second pistons are movably supported by the housing. In a shallow mode, displacement of the first piston alters a buoyancy of the buoyancy control system. In a deep mode, displacement of the first and second pistons alters the buoyancy of the buoyancy control system.

The present invention may be embodied in other configurations as will become apparent from the following discussion of examples of the present invention.

DETAILED DESCRIPTION OF THE INVENTION

Figure 1:
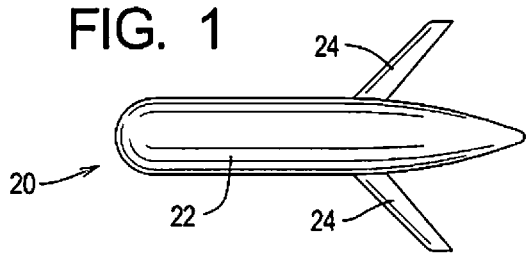
FIG. 1 is a top plan view of an example glider incorporating a first example buoyancy control system of the present invention.
Figure 2:
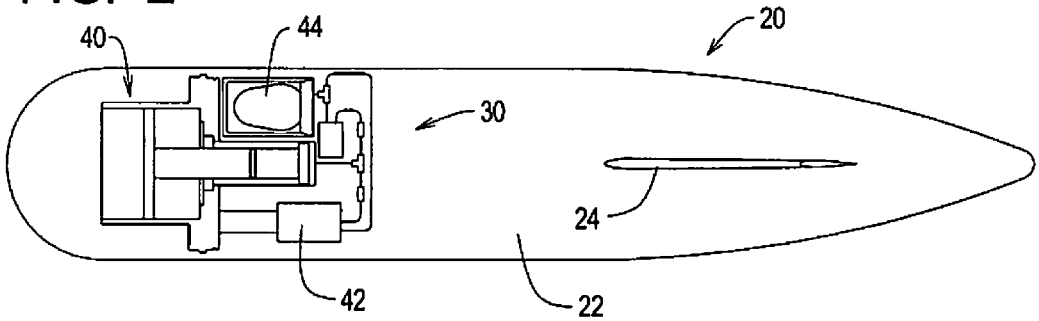
FIGS. 2-4 are side elevation, partial schematic views illustrating the operation of the example glider of FIG. 1.
Figure 3:
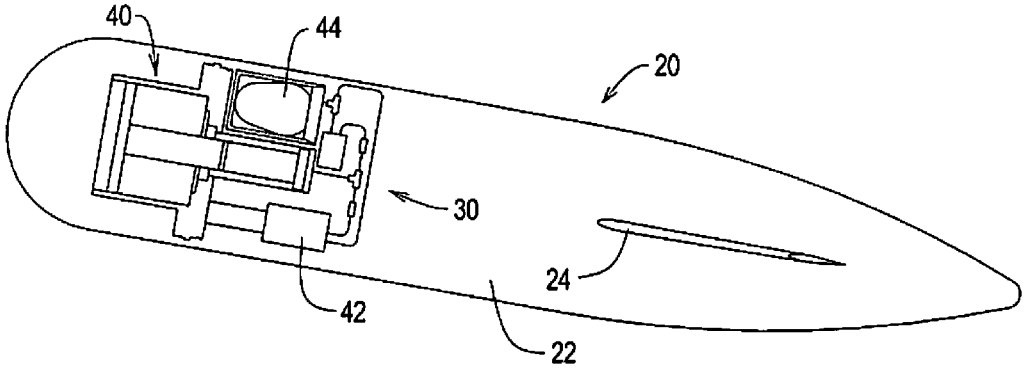

Referring initially to FIG. 1 of the drawing, depicted therein is an example waterborne vessel in the form of a glider 20. The example glider 20 is generally conventional in that it comprises a hull assembly 22 and one or more fins and/or wings 24. FIGS. 2-3 illustrate that the example glider 20 further comprises a buoyancy control system 30 arranged within the hull assembly 22.

Figure 5:
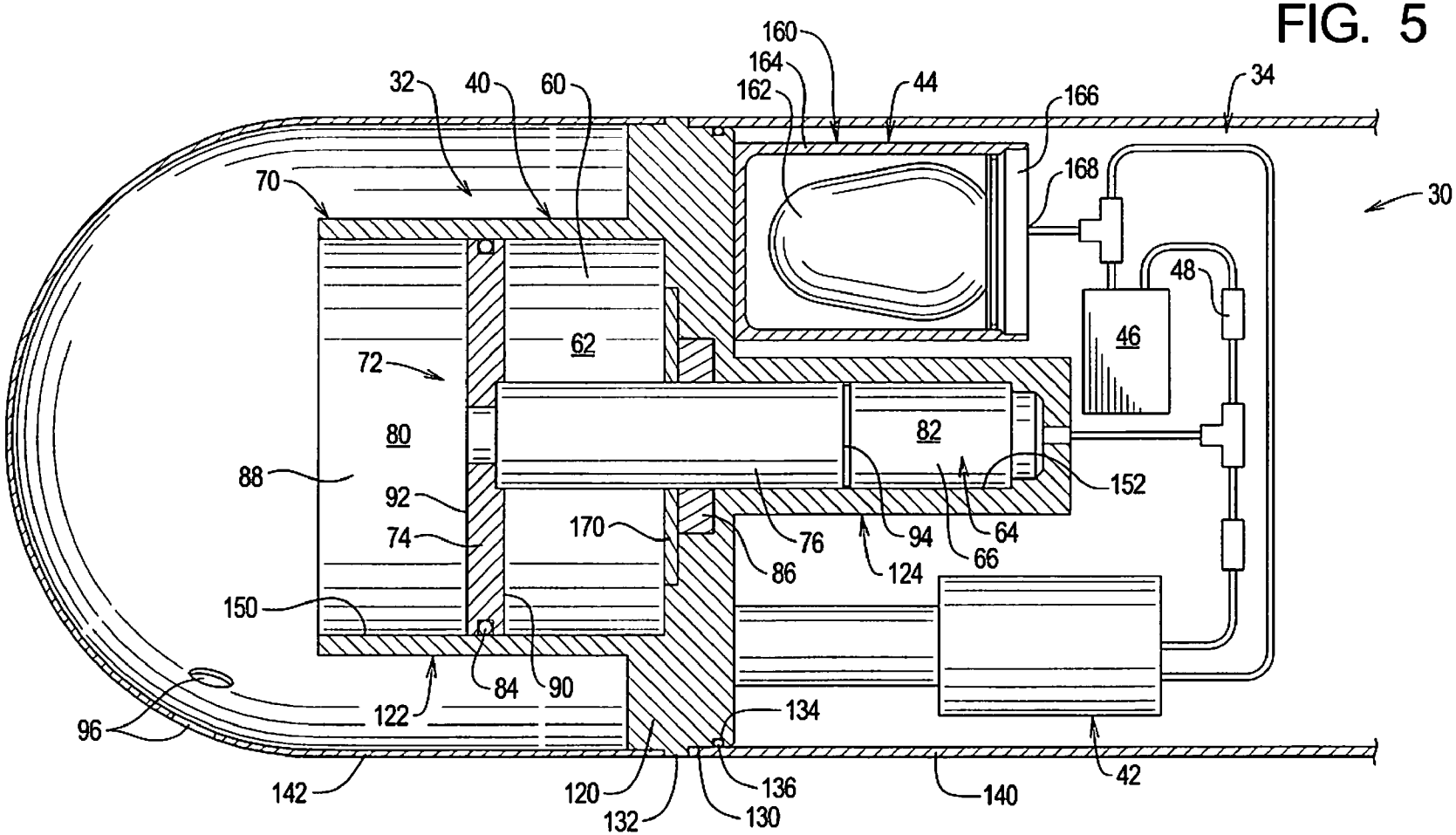
FIG. 5 is a somewhat schematic view side elevation, cross-sectional view depicting details of a first example buoyancy control system as mounted within the example glider of FIG. 1.
Figure 6:
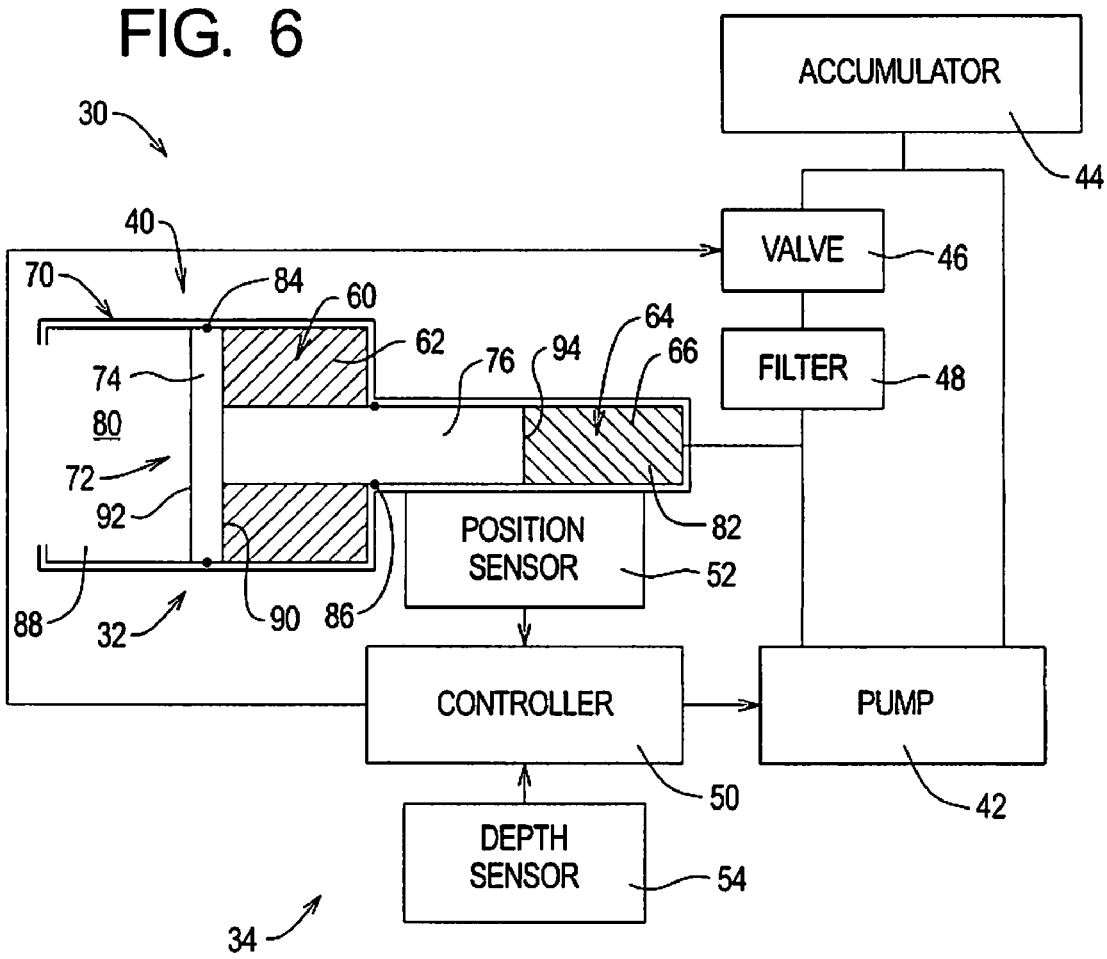
FIG. 6 is a schematic block diagram illustrating an electrical control portion of the first example buoyancy control system.
Figure 7:
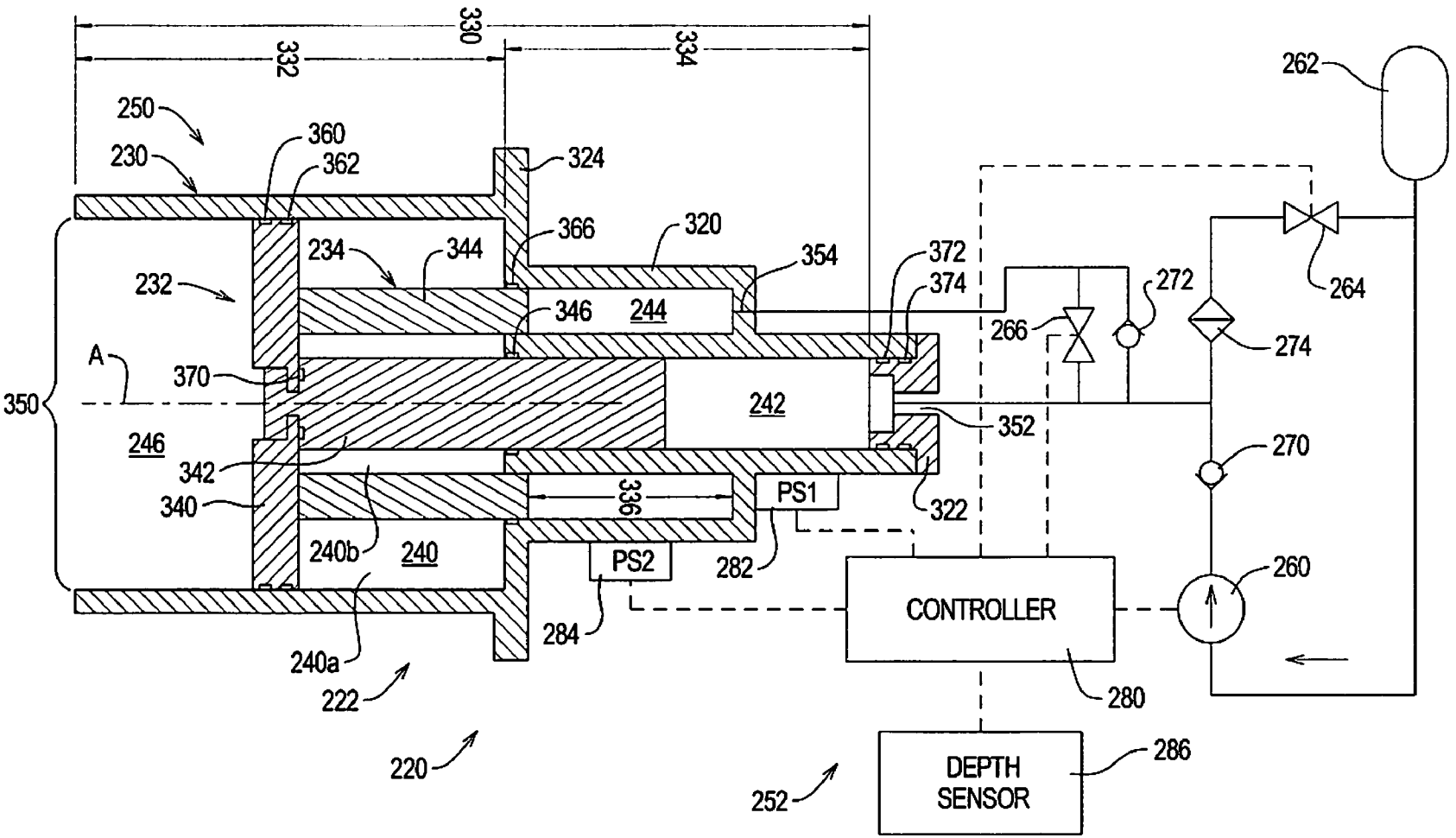
FIG. 7 is a schematic side elevation, cross-sectional view of a second example buoyancy control system that may be used by the example glider of FIG. 1 in place of the first example buoyancy control system described herein.

The buoyancy control system 30 is depicted in further detail in FIGS. 5-7 of the drawing. In particular, FIG. 5 illustrates details of a mechanical portion 32 of the buoyancy control system 30, while FIG. 6 schematically illustrates both the mechanical portion 32 and a control portion 34 of the buoyancy control system 30.

Referring initially to FIG. 6 of the drawing, it can be seen that the example mechanical portion 32 comprises a piston assembly 40, a pump assembly 42, an accumulator assembly 44, a valve assembly 46, and a filter 48. FIG. 6 further shows that the example control portion 34 comprises a controller 50, a position sensor 52, and a depth sensor 54. The piston assembly 40 defines a control chamber 60 containing a control fluid 62 and a working chamber 64 comprising a working fluid 66. The control fluid 62 is compressible, while the working fluid 66 is incompressible.

In use, the controller 50 operates the pump assembly 42 and the valve assembly 46 to introduce the operating fluid 66 into and withdraw operating fluid 66 from the working chamber 64 to change a configuration of the piston assembly 40. In particular, the controller 50 controls the pump assembly 42 and the valve assembly 46 to cause working fluid to flow into and out of the working chamber 64. As the working fluid flows into and out of the working chamber 64, the configuration of the piston assembly 40 is changed.

As the configuration of the piston assembly 40 changes, the volume of the control chamber 60 changes. Increasing the volume of the control chamber 60 increases the buoyancy of the buoyancy control system 30. Decreasing the volume of the control chamber 60 decreases the buoyancy of the buoyancy control system 30. Accordingly, as the configuration of the piston assembly 40 changes, the buoyancy of the buoyancy control system 30 changes.

Figure 4:
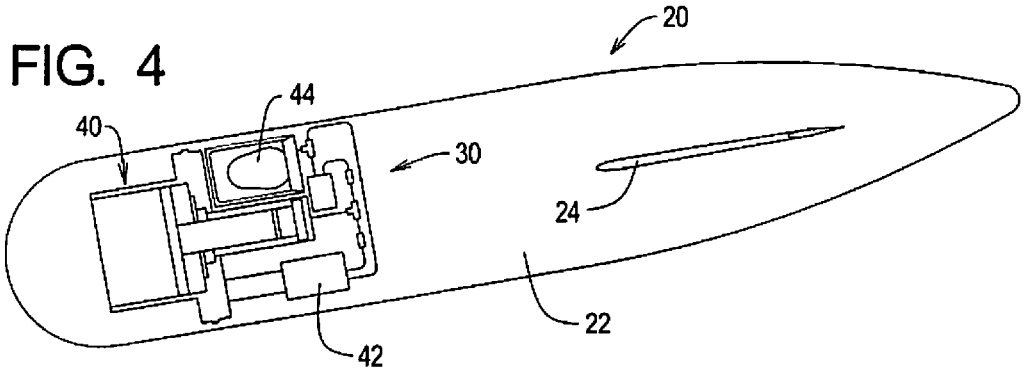

Referring for a moment back to FIGS. 2-4, it can be seen that, as the buoyancy of the buoyancy control system 30 changes, the attitude of the glider 20 changes. Ideally, the buoyancy of the glider 20 (without the buoyancy control to system 30 or with the buoyancy control system 30 in a neutral configuration) is substantially constant, at or near neutral, and distributed evenly so that the attitude of the glider 20 is substantially horizontal. Accordingly, when the buoyancy of the buoyancy control system 30 is substantially neutral, the attitude of the glider 20 is substantially horizontal (FIG. 2). When the buoyancy of the buoyancy control system 30 is positive, the axis of the glider 20 is upwardly canted (FIG. 3).

And when the buoyancy of the buoyancy control system 30 is negative, the axis of the glider 20 is downwardly canted (FIG. 3).

The buoyancy control system 30 thus allows the example glider 20 to be maneuvered through the water in the manner of a conventional glider. The buoyancy control system 30 may be used to control the buoyancy of any vessel that is designed to function underwater, whether designed to move without propulsion (e.g., a glider), designed to move with propulsion (e.g., a torpedo), or designed to move up and down within a substantially static water column (e.g., a float or buoy).

With the foregoing general understanding of the principles of the present invention in mind, the construction and operation of the example buoyancy control system 30 will now be described in further detail.

As shown in both FIGS. 5 and 6 of the drawing, the example piston assembly 40 comprises a piston housing 70 and a piston member 72. The piston member 72 comprises a piston portion 74 and a shaft portion 76. The piston member 72 is arranged within the piston housing 70 to define the control chamber 60 and the working chamber 64.

In particular, the piston housing 70 defines a low pressure cavity 80 and a high pressure cavity 82. Further, a first seal member 84 is mounted on the piston portion 74 of the piston member 72, and a second seal member 86 is mounted on the piston housing 70. The piston portion 74 thus divides the low pressure cavity 80 into an ambient chamber 88 and the control chamber 60. The shaft portion 76 lies within the high pressure cavity 82, and the portion of the high pressure cavity 82 not occupied by the shaft portion 76 is the working chamber 64. The first seal member 84 prevents fluid flow between the control chamber 60 and the ambient chamber 88, while the second seal member 86 prevents fluid flow between the control chamber 60 and the working chamber 64.

The piston portion 74 of the piston member defines a control surface 90 and an ambient surface 92. The shaft portion 76 of the piston member 72 defines a working surface 94. When the working fluid 66 is forced into the working chamber 64, the working fluid 66 acts on the working surface 94 to displace the shaft portion 76 in a first direction. The shaft portion 76 is connected to the piston portion 74 such that, as the shaft portion 76 moves in the first direction, the piston portion 74 also moves in the first direction. As the piston portion 74 moves in the first direction, the volume of the control chamber 60 increases.

When the working fluid 66 is forced out of the working chamber 64, the working fluid 66 acts on the working surface 94 to displace the shaft portion 76 in a second direction opposite the first direction. Because the shaft portion 76 is connected to the piston portion 74, as the shaft portion 76 moves in the second direction, the piston portion 74 also moves in the second direction. As the piston portion 74 moves in the second direction, the volume of the control chamber 60 decreases.

When the volume of the working fluid 66 in the working chamber 64 is held constant, the shaft portion 76 does not move. Because the shaft portion 76 is connected to the piston portion 74, if the shaft portion 76 does not move, the piston portion 74 also does not move. When the piston portion 74 is not moving, the volume of the control chamber 60 does not change.

Accordingly, by forcing working fluid 66 into the working chamber 64, forcing working fluid 66 out of the working chamber 64, and preventing the working fluid 66 from flowing into our out of the working chamber 64, the volume of the control chamber 60 can be increased, decreased, or held constant. Controlling the volume of the control chamber 60 thus allows the buoyancy of the buoyancy control system 30 to be increased, decreased, or held constant.

Referring for a moment back to FIG. 5, it can be seen that holes 96 are formed in the glider hull assembly 22 to allow water to flow into and out of the ambient chamber 88. The ambient chamber 88 is thus in fluid communication with the water surrounding the glider 20. Accordingly, when the volume of the control chamber 60 increases, water is expelled from the glider 20. Conversely, when the volume of the control chamber 60 decreases, water is drawn into the glider 20.

The example controller 50 shown in FIG. 6 generates a pump control signal for turning the pump assembly 42 on or off and a valve control signal for placing the valve assembly 46 in a closed configuration or an open configuration. By operating the pump assembly 42 with the valve assembly 46 in the closed configuration, the working fluid 66 is forced into the working chamber 64 to displace the piston member 72 in the first direction. By turning off the pump assembly 42 with the valve assembly 46 in the closed configuration, the volume of working fluid 66 within the working chamber 64 is held constant.

Accordingly, when the pump assembly 42 is off and the valve assembly 46 is in the open configuration, pressure on the ambient surface 92 of the piston portion 74 forces working fluid out of the working chamber 64 and into the accumulator assembly 44.

Referring now more specifically to FIG. 5, it can be seen that the piston housing 70 comprises a bulkhead portion 120, a low pressure portion 122, and a high pressure portion 124.

The example bulkhead portion 120 defines an annular surface 130 defining a stop flange 132 and a seal groove 134 that receives a seal member 136. FIG. 5 also shows that the hull assembly 22 of the glider 20 comprises a main portion 140 and a nose cone portion 142. The main portion 140 is attached to the annular surface 130 to rigidly connect the main portion 140 to the bulkhead portion 120. The seal member 136 forms a fluid tight seal at the juncture of the bulkhead portion 120 and the main portion 140. The nose cone portion 142 is also attached to the annular surface 130 to rigidly connect the nose cone portion 142 to the bulkhead portion 120.

The example low pressure portion 122 and high pressure portion 124 extend from the bulkhead portion 120 and define the low pressure cavity 80 and high pressure cavity 82, respectively. The example low pressure cavity 80 is defined by a cylindrical inner surface 150 of the low pressure portion 122, while the example high pressure cavity 82 is defined by a cylindrical inner surface 152 of the high pressure portion 124.

The example controller 50 shown in FIG. 6 is or may be a general purpose computing device running a software program. While the functions of the controller 50 can be implemented using dedicated electronics, the use of a general purpose computing device running a software program facilitates the changing of the logic carried out by the control system 34.

As shown in FIG. 6, the controller 50 generates the pump control signal and the valve control signal based on one or more inputs. The controller 50 may function solely based on logic embodied in the software program, may function in response to external commands received through a communications system, or may function based on a combination of software program logic and external commands. The example system 30 operates based on a position sensor signal generated by the position sensor 52 and a depth signal generated by the depth sensor 54. Alternative inputs include an attitude signal generated by an attitude sensor, a salinity signal generated by a salinity sensor, and a temperature signal generated by a thermometer.

The example accumulator assembly 44 will now be described in further detail with reference to FIG. 5. The accumulator assembly 44 comprises an accumulator housing assembly 160 and a pressure bag 162. The accumulator housing assembly 160 comprises a main portion 164 and a cap portion 166. A port 168 formed in the cap portion 166 is operatively connected to the pump assembly 42 and the valve assembly 46 as generally described above.

With the pump assembly 42 and the valve assembly 46 in a first set of configurations, pressurized working fluid 66 flows into the housing assembly 160 through the port 168 to collapse the pressure bag 162. The pressure bag 162 thus allows working fluid 66 to flow into the accumulator 44 under pressure. The stored working fluid 66 is pressurized such that the working fluid 66 is forced out of the accumulator 44 when the pump assembly 42 and the valve assembly 46 are in a second set of configurations.

The accumulator 44 thus functions to store working fluid 66 under pressure for use by the buoyancy control system 30 as described above. The construction and operation of the example accumulator 44 is appropriate for use by the buoyancy control system 30, but any accumulator that functions in a similar manner may be used by a buoyancy control system of the present invention.

FIG. 5 further illustrates that the example second seal member 86 is mounted on or within the piston housing 70 by a seal retaining member 170. The second seal member 86 and the seal retaining member are disk-shaped members through which the shaft portion 76 of the piston member 72 extends. The example second seal member 86 helps to support the piston member 72 for movement as shown in FIGS. 2-4, establishes a fluid tight seal between the control chamber 60 and the working chamber 64, and allows easy assembly and maintenance of the piston assembly 40.

Referring now to FIG. 7 of the drawing, depicted at 220 therein is a second example buoyancy control system of the present invention. Referring initially to FIG. 7 of the drawing, it can be seen that the example buoyancy control system 220 comprises a piston assembly 222 comprises a piston housing 230, a first piston 232, and a second piston 234; the housing 230 and pistons 232 and 234 define a control chamber 240, a first working chamber 242, and a second working chamber 244. The housing 230 and first piston 232 further define an ambient chamber 246.

Figure 8:
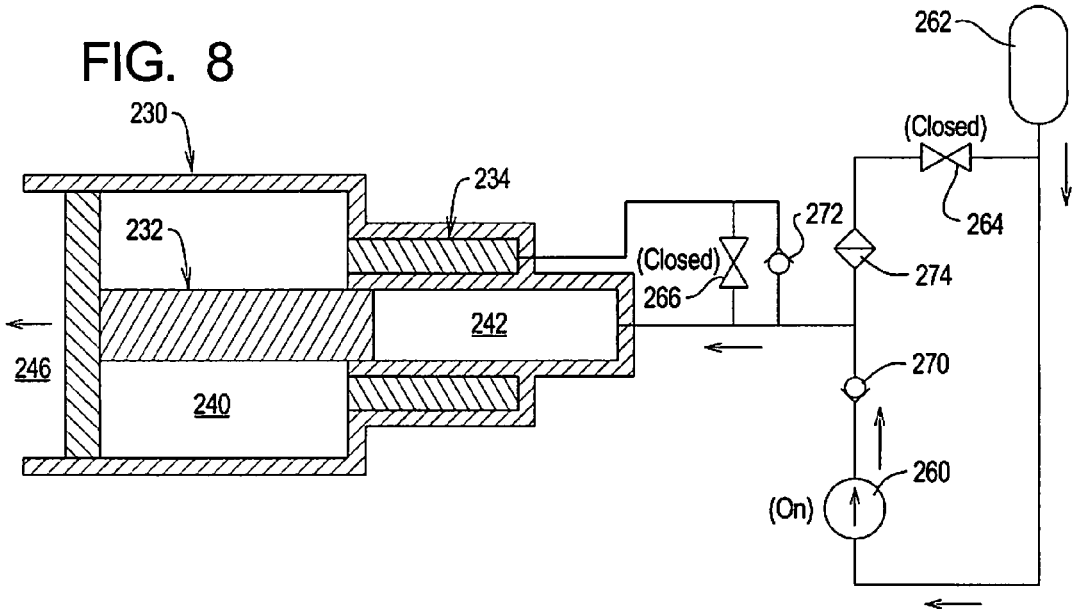
FIG. 8 is a side elevation, cross-sectional view of the second example buoyancy control system expelling ambient fluid in a shallow mode.
Figure 9:
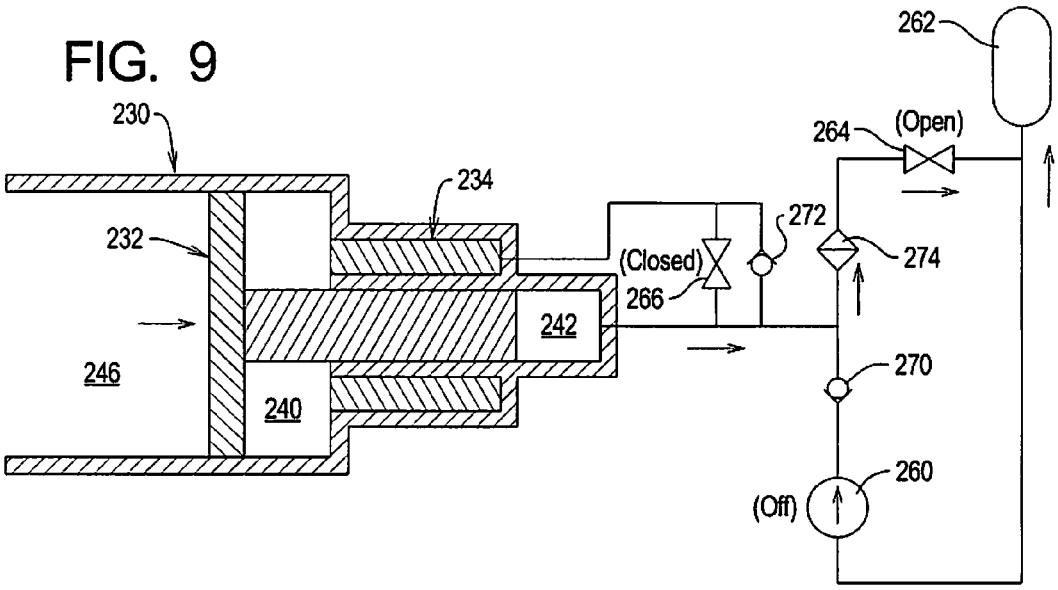
FIG. 9 is a side elevation, cross-sectional view of the second example buoyancy control system ingesting ambient fluid in the shallow mode.
Figure 10:
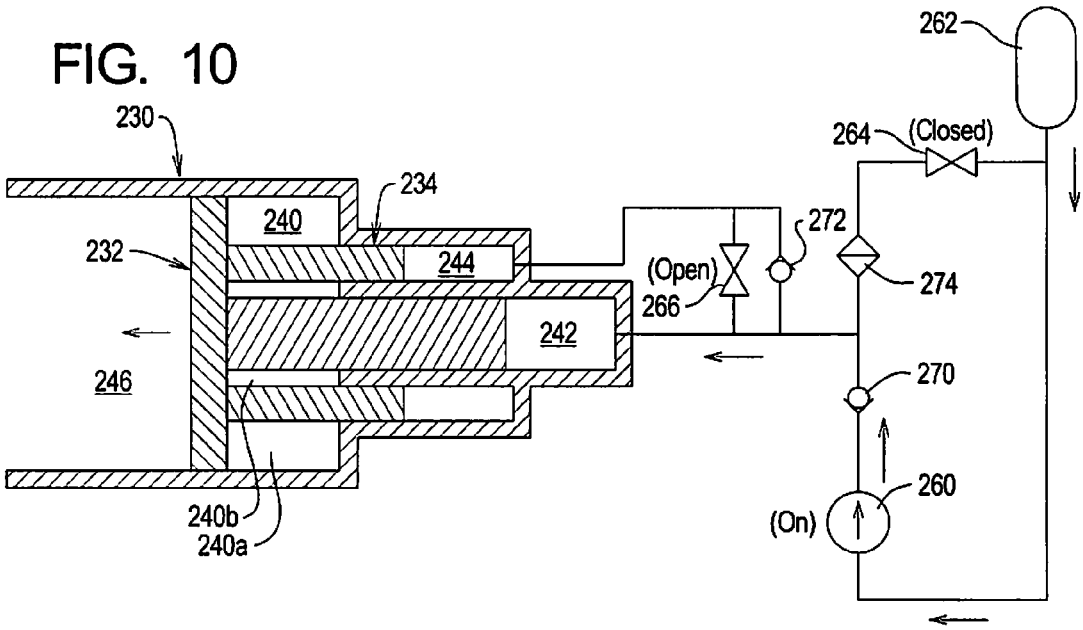
FIG. 10 is a side elevation, cross-sectional view of the second example buoyancy control system expelling ambient fluid in a deep mode.
Figure 11:
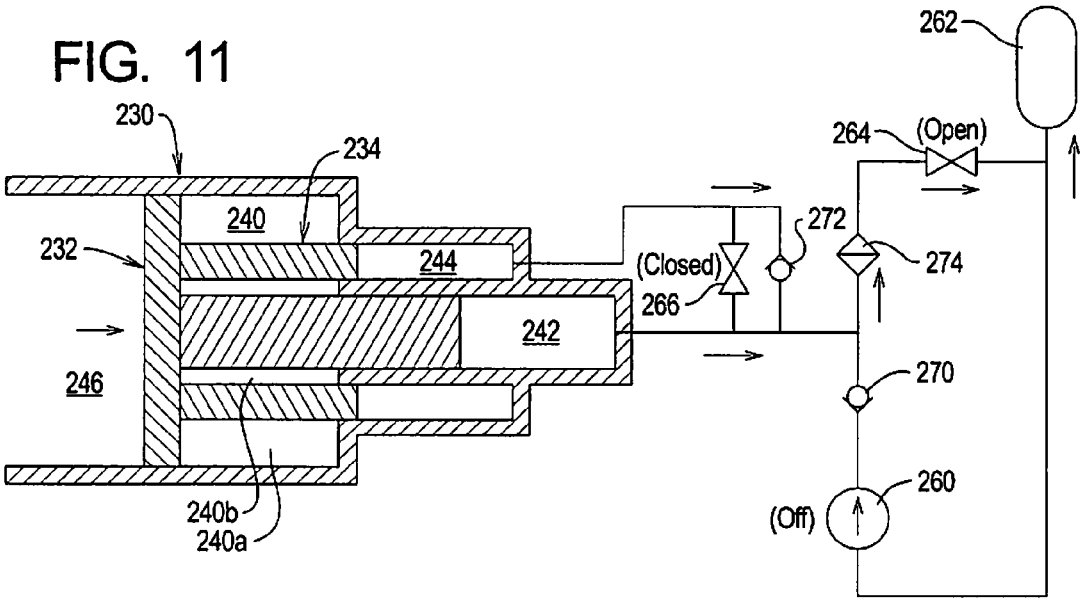
FIG. 11 is a side elevation, cross-sectional view of the second example buoyancy control system ingesting ambient fluid in the deep mode.

In a shallow mode as depicted in FIGS. 8 and 9, working fluid is introduced into the first working chamber 242 to displace the first piston 232 and thereby alter a volume of the control chamber 240. In a deep mode as depicted in FIGS. 10 and 11, working fluid is introduced into both the first and the second working chambers 242 and 244 to displace the first and second pistons 232 and 234 to alter a volume of the control chamber 240. In the deep mode, however, the second piston 234 occupies a portion of the control chamber and divides the control chamber 240 into a first portion 240*a* and a second portion 240*b*.

By altering a volume of the control chamber 240 as generally described above, ambient fluid is drawn into or displaced from the ambient chamber 246, and the buoyancy of the buoyancy control system 220 is altered. By altering the buoyancy of the buoyancy control system 220, the buoyancy and attitude of a glider or other submersible object in which the buoyancy control system 220 is mounted may also be altered. Altering the buoyancy of a glider allows the glider to be controlled as generally described above with reference to FIGS. 2-4.

However, the buoyancy control system 220 is adaptable to allow the system 220 to operate more effectively at the different pressures associated with shallow and deep depths. In particular, the parameters of the buoyancy control system 220 are predetermined to provide optimal control within a first range of depths (e.g., 0-X feet) when operating in the shallow mode and also optimal control within a second range of depths (e.g., greater than X feet) in the deep mode.

In the deep mode, the use of both the first and the second pistons 232 and 234 increases the hydraulic pressure available to overcome the higher ambient pressures experience at greater depths. Additionally, the maximum volume of the control chamber 240 is effectively decreased in the deep mode, allowing finer control buoyancy changes at greater depths when the system 220 operates in the deep mode.

With the foregoing general understanding of the construction and operation of the second example buoyancy control system 220, the details of the second example buoyancy control system 220 will now be described in further detail.

As shown in FIG. 7, the second example buoyancy control system 220 comprises a mechanical/hydraulic portion 250 and a control portion 252. In addition to the piston assembly 222 generally described above, the example mechanical/hydraulic portion 250 comprises a pump assembly 260, an accumulator assembly 262, first and second valve assemblies 264 and 266, first and second check valves 270 and 272, and a filter 274. The output of the pump assembly 260 is operatively connected through the first check valve 270 to the first working chamber 242 and through the filter 274 and first valve assembly 264 to the accumulator assembly 262. The accumulator assembly 262 is operatively connected to the input of the pump assembly 260. The output of the pump assembly 260 is also operatively connected through the first check valve 270 to the second working chamber through the second valve assembly 266. The second check valve assembly 272 is connected in parallel with the second valve assembly 266.

FIG. 7 further shows that the example control portion 252 comprises a controller 280, first and second position sensors 282 and 284, and a depth sensor 286. The example controller 280 is electrically connected to the first and second valve assemblies 264 and 266, the first and second position sensors 282 and 284, and the depth sensor 286.

The example controller 280 is a computer processor running software that causes the first and second valve assemblies 264 and 266 to open and close based on factors such as locations of the pistons 232 and 234 as detected by the position sensors 282 and 284 and the depth of the submersible object as detected by the depth sensor 286.

In particular, depending upon the depth of the buoyancy control system 220 as detected by the depth sensor 286, the controller 280 operates in either the shallow mode or the deep mode. The controller 280 places the second valve assembly 266 in its OFF configuration (prevents fluid flow) to allow the system 220 to operate in the shallow mode. In the shallow mode, placing the pump assembly 260 in its ON configuration and the first valve assembly 264 in its OFF configuration (prevents fluid flow) causes the buoyancy control system 220 to increase the volume of the control chamber 240 and expel ambient fluid by applying a force to extend the first piston 232 (FIG. 8). When the system is in the shallow mode, placing the pump assembly 260 in its OFF configuration and the first valve assembly in its ON configuration causes the system 220 to decrease a volume of the control chamber 240 and intake ambient fluid. When the pump assembly 260 is OFF, the ambient fluid applies a force on the first piston 232 that causes the first piston 232 to retract (FIG. 9). Placing the pump assembly 260 in its OFF configuration and the first valve assembly 264 in its OFF configuration allows a particular buoyancy configuration to be maintained.

Placing the second valve assembly 266 in its ON configuration allows the system 220 to operate in the deep mode. In the deep mode, placing the pump assembly 260 in its ON configuration and the first valve assembly 264 in its OFF configuration causes the buoyancy control system 220 to expel ambient fluid by applying a force to extend the first and second pistons 232 and 234 (FIG. 10). When the system is in the deep mode, placing the pump assembly 260 in its OFF configuration and the first valve assembly in its ON configuration causes the system 220 to intake ambient fluid. Again, when the pump 260 is OFF, the ambient fluid applies a force on the first piston 232 that causes the first and second pistons 232 and 234 to retract (FIG. 11). Again, placing the pump assembly 260 in its OFF configuration and the first valve assembly 264 in its OFF configuration allows a particular buoyancy configuration to be maintained.

The example housing 230 comprises a body 320 and a cap member 322. A mounting flange 324 extends from the body 320 to facilitate connection of the housing 230 to the submersible device in which the buoyancy control system 220 is to be mounted. The body 320 is substantially symmetrical about a longitudinal axis A and defines a main cavity 330 comprising a first cylindrical portion 332, a second cylindrical portion 334, and an annular portion 336.

The first piston 232 is an assembly comprising a plate member 340 and a rod member 342. The plate member 340 resides in the first cavity portion 332, while the rod member 342 resides partly within the first cavity portion 332 and partly within the second cavity portion 334. The second piston 234 is or comprises an annular member 344 sized and dimensioned to fit within the annular cavity portion 336. The housing body 320 further defines an ambient opening 350. The cap member 324 defines a main port 352, and the body 320 defines at least one secondary port 354.

First and second seal members 360 and 362 are arranged between the plate member 340 and the body 320 to prevent fluid flow from the control chamber 240 and the ambient chamber 246. A third seal member 364 is arranged between the rod member 342 and the body 320 to inhibit fluid flow between the first working chamber 242 and the control chamber 240. A fourth seal member 366 is arranged between the annular member 344 and the body 320 to inhibit fluid flow between the second working chamber 244 and the first portion 240*a* of the control chamber 240. A fifth seal member 370 is arranged between the plate member 340 and the rod member 342 to prevent fluid flow from the control chamber 240 to the ambient chamber 246. Sixth and seventh seal members 372 and 374 are arranged between the body 320 and the cap 322 to prevent fluid flow from the first working chamber 242 to the exterior of the body 320.

Figure 12:
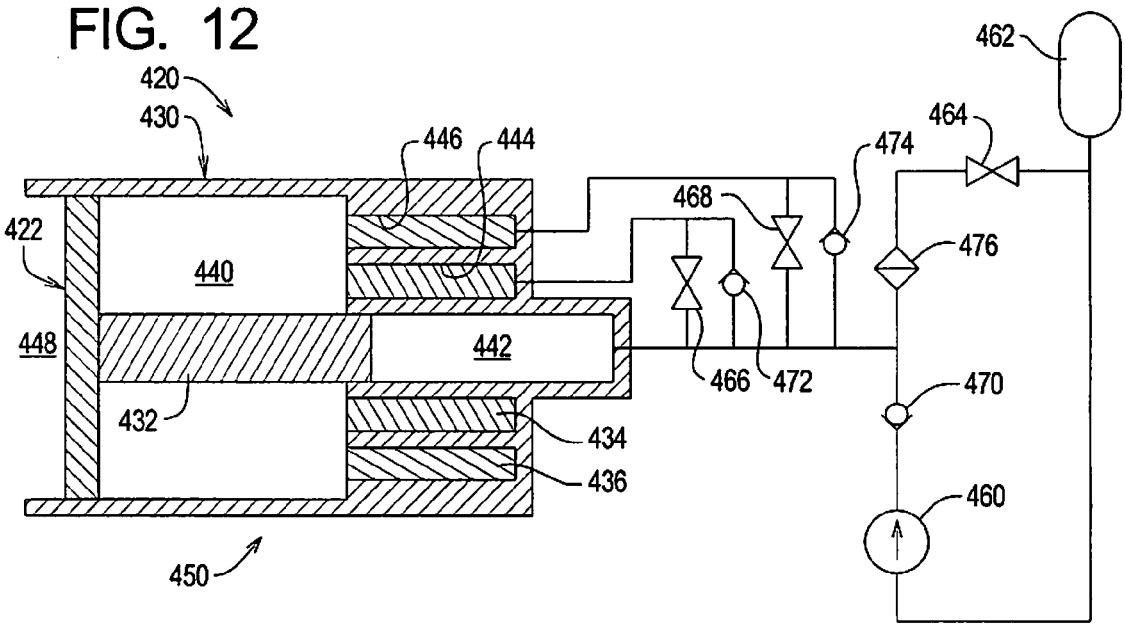
FIG. 12 is a side elevation, cross-sectional view of the second example buoyancy control system in a shallow mode.
Figure 13:
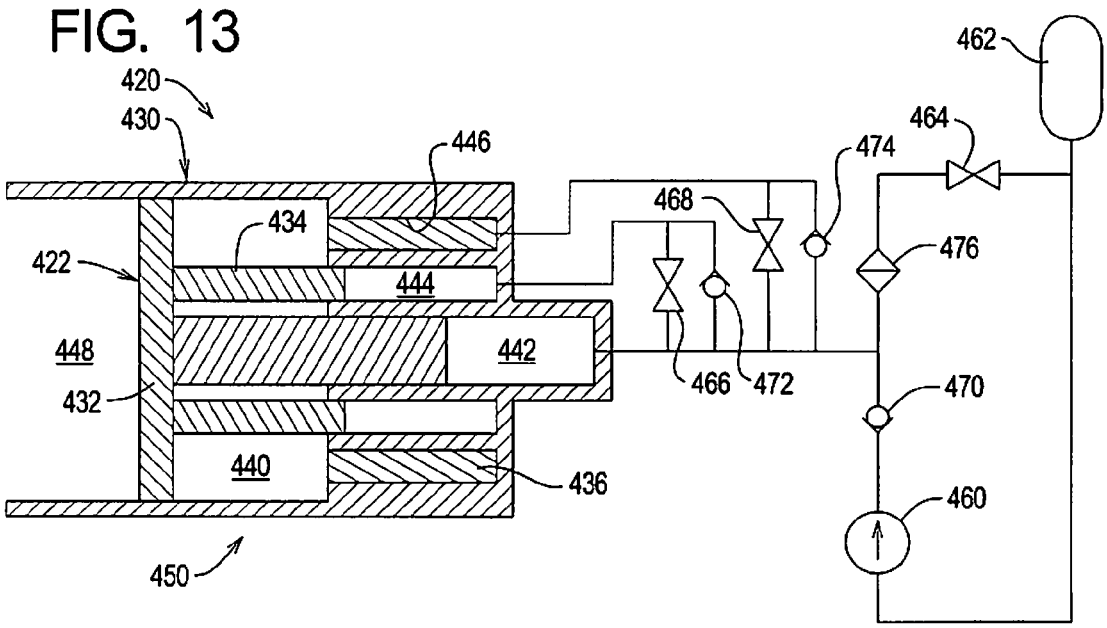
FIG. 13 is a side elevation, cross-sectional view of the second example buoyancy control system in an intermediate mode.
Figure 14:
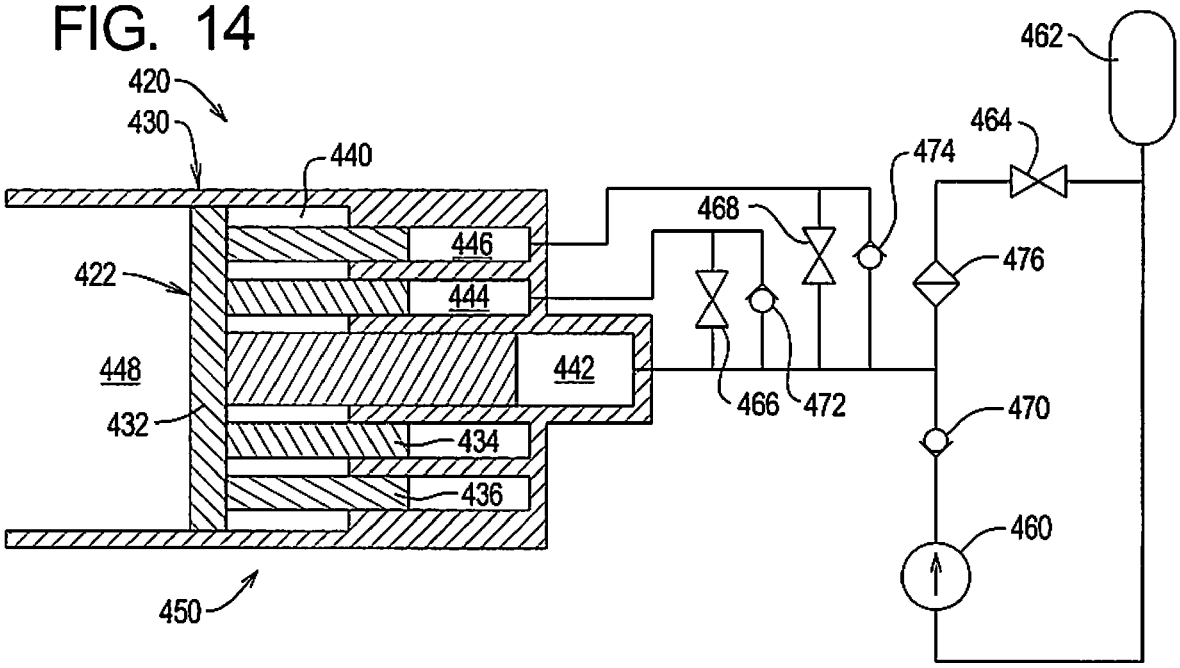
FIG. 14 is a side elevation, cross-sectional view of the second example buoyancy control system in a deep mode.

Referring now to FIGS. 12-14, a third example buoyancy control system 420 will now be described. The example buoyancy control system 420 is in many respects similar to the buoyancy control system 220 described above and will be described below only to the extent necessary for a complete understanding of the present invention.

The third example buoyancy control system 420 comprises a piston assembly 422 comprises a piston housing 430, a first piston 432, a second piston 434, and a third piston 436. The housing 430 and pistons 432, 434, and 436 define a control chamber 440, a first working chamber 442, a second working chamber 444, and a third working chamber 446. The housing 430 and first piston 432 further define an ambient chamber 448.

In a shallow mode as depicted in FIG. 12, working fluid is introduced into the first working chamber 442 to displace the first piston 432 and thereby alter a volume of the control chamber 440. In an intermediate mode as depicted in FIG. 13, working fluid is introduced into the first and the second working chambers 442 and 444 to displace the first and second pistons 432 and 434 to alter a volume of the control chamber 440. In a deep mode as depicted in FIG. 14, working fluid is introduced into the first, second, and third working chambers 442, 444, and 446 to displace the first and second pistons 432 and 434 to alter a volume of the control chamber 440.

By altering a volume of the control chamber 440 as generally described above, ambient fluid is drawn into or displaced from the ambient chamber 448, and the buoyancy of the buoyancy control system 420 is altered. By altering the buoyancy of the buoyancy control system 420, the buoyancy and attitude of a glider or other submersible object in which the buoyancy control system 420 is mounted may also be altered. Altering the buoyancy of a glider allows the glider to be controlled as generally described above with reference to FIGS. 2-4.

However, the buoyancy control system 420 is adaptable to allow the system 420 to operate more effectively at the different pressures associated with shallow, intermediate, and deep depths. In particular, in the intermediate mode, the second piston 434 occupies a portion of the control chamber 440, while, in the deep mode, the second piston 434 and the third piston 434 occupy portions of the control chamber 440. The parameters of the third buoyancy control system 420 may thus be predetermined to provide optimal control within a first range of depths (e.g., from 0 to X feet) when operating in the shallow mode, within a second range of depths (e.g., from X to Y feet) in the deep mode, and within a third range of depths (e.g., greater than Y feet) in the deep mode.

In the intermediate and deep modes, the use of the second and or third pistons 434 and 436 in addition to the first piston 432 increases the hydraulic to pressure available to overcome the ambient pressures experienced at different depths. Additionally, the maximum volume of the control chamber 440 is effectively decreased in the intermediate and deep modes, allowing finer control buoyancy changes at progressively greater depths when the system 420 operates in the intermediate and deep mode.

The third example buoyancy control system 420 comprises a mechanical/hydraulic portion 450 and a control portion (not shown). The control portion will be generally similar to the control portion 252 described above and will not be described in detail.

In addition to the piston assembly 422 generally described above, the example mechanical/hydraulic portion 450 comprises a pump assembly 460, an accumulator assembly 462, first, second, and third valves 464, 466, and 468, first, second, and third check valves 470, 472, and 474 and a filter 476.

The output of the pump assembly 460 is operatively connected through the first check valve 470 to the first working chamber 442 and through the filter 476 and first valve 464 to the accumulator assembly 462. The accumulator assembly 462 is operatively connected to the input of the pump assembly 460. The output of the pump assembly 460 is also operatively connected through the first check valve 470 to the second working chamber through the second valve 466. The second check valve 472 is connected in parallel with the second valve 466. The output of the pump assembly 460 is further operatively connected through the first check valve 470 to the third working chamber 446 through the third valve 468. The third check valve 474 is connected in parallel with the third valve 468.

The following table lists the status of the pump 460 and the first, second, and third valves 464, 466, and 468 when the control portion controls the third example buoyancy control system 420 to intake and expel ambient fluid under the shallow, intermediate, and deep modes:

| Mode | Intake/Expel | Pump | First Valve | Second Valve | Third Valve |
|---|---|---|---|---|---|
| shallow | expel | ON | OFF | OFF | OFF |
| shallow | intake | OFF | ON | OFF | OFF |
| intermediate | expel | ON | OFF | ON | OFF |
| intermediate | intake | OFF | ON | ON | OFF |
| deep | expel | ON | OFF | ON | ON |
| deep | intake | OFF | ON | ON | ON |

Given the foregoing, it should be apparent that the present invention may be embodied in forms other than those described above. For example, the present invention has been disclosed with one, two, and three pistons to operate in three modes, but additional pistons can be provided based on desired operating ranges and conditions to operate in more than three modes. The scope of the present invention should be determined by the claims appended hereto and not the following descriptions of examples of the invention.

Given the foregoing, it should be apparent that the present invention may be embodied in forms other than those described above. The scope of the present invention should be determined by the claims appended hereto and not the following descriptions of examples of the invention.

What is claimed is:

1. A buoyancy control system comprising:

a housing;

a first piston supported by the housing such that movement of the first piston changes a volume of a control chamber;

a second piston supported by the housing such that movement of the second piston changes the volume of the control chamber;

a source of pressurized working fluid; and first and second valves operatively connected between the source of pressurized fluid and the first and second pistons to allow pressurized working fluid to displace at least one of the first and second pistons relative to the housing; wherein the buoyancy control system is operable in a shallow mode in a first range of depths and in a deep mode in a second range of depths;

in the shallow mode, the first and second valves are controlled to allow fluid to flow from the source of pressurized fluid to the first piston such that the pressurized fluid displaces the first piston to alter the volume of the control chamber and thus a buoyancy of the buoyancy control system; and in the deep mode, the first and second valves are controlled to allow fluid to flow from the source of pressurized fluid to the first and second pistons such that the pressurized fluid displaces both of the first and second pistons to alter the volume of the control chamber and thus the buoyancy of the buoyancy control system.

2. A buoyancy control system as recited in claim 1, in which:

the housing and the first and second pistons define a first working chamber and a second working chamber; and introduction of the working fluid into at least one of the first and second working chambers displaces at least one of the first and second pistons relative to the housing.

3. A buoyancy control system as recited in claim 1, in which:

the housing and the first and second pistons define a first working chamber and a second working chamber; and introduction of the working fluid into at least one of the first and second working chambers displaces at least one of the first and second pistons relative to the housing to alter the volume of the control chamber.

4. A buoyancy control system as recited in claim 1, in which:

the housing and the first and second pistons define an ambient chamber, a first working chamber, and a second working chamber; and introduction of the working fluid into at least one of the first and second working chambers displaces at least one of the first and second pistons relative to the housing to alter the volume of the control chamber and an amount of ambient fluid within the ambient chamber.

5. A buoyancy control system as recited in claim 1, further comprising:

first and second working chambers defined by the housing and the first and second pistons; and the source of pressurized fluid comprises an accumulator, and a pump connected to the first working chamber; whereby the first valve is connected between the pump and the accumulator;

the second valve is connected between the pump and the second working chamber;

in the shallow mode, the second valve is operated to prevent fluid flow into and out of the second working chamber; and in the deep mode, the second valve is operated to allow fluid flow into and out of the second working chamber.

6. A buoyancy control system as recited in claim 5, in which:

the pump is turned on and the first valve is operated to prevent fluid flow between the pump and the accumulator to displace at least one of the first and second pistons in a first direction; and the pump is turned off and the first valve is operated to allow fluid flow between the first and second working chambers and the accumulator to displace at least one of the first and second pistons in a second direction.

7. A method of controlling buoyancy of a submersible object comprising the steps of:

arranging a housing within the submersible object;

arranging first and second pistons within the housing to define a control chamber;

supporting the first piston for movement within the housing such that movement of the first piston changes a volume of the control chamber;

supporting a second piston for movement within the housing such that movement of the second piston changes the volume of the control chamber;

providing a source of pressurized working fluid;

operating first and second valves to allow pressurized working fluid to displace the first piston to alter a buoyancy of the submersible object in a first range of depths; and operating first and second valves to allow pressurized working fluid to displace the first and second pistons to alter the buoyancy of the submersible object in a second range of depths.

8. A method as recited in claim 7, in which:

the housing and the first and second pistons define a first working chamber and a second working chamber; and the steps of displacing the first and second pistons comprises the step of introducing the working fluid into at least one of the first and second working chambers.

9. A method as recited in claim 7, in which:

the housing and the first and second pistons define a first working chamber and a second working chamber; and the steps of displacing the first and second pistons comprises the step of introducing the working fluid into at least one of the first and second working chambers to displace at least one of the first and second pistons and thereby alter the volume of the control chamber.

10. A method as recited in claim 7, in which:

the housing and the first and second pistons define an ambient chamber, a first working chamber, and a second working chamber; and the steps of displacing the first and second pistons comprises the step of introducing the working fluid into at least one of the first and second working chambers to displace at least one of the first and second pistons and thereby alter the volume of the control chamber and an amount of ambient fluid within the ambient chamber.

11. A method as recited in claim 7, in which:

the steps of supporting the first and second pistons relative to the housing comprises the step of defining first and second working chambers; and the step of providing a source of pressurized fluid comprises the step of providing a pump and an accumulator;

the method further comprising the steps of;

connecting the first valve between the pump and the accumulator; connecting the second valve between the pump and the second working chamber;

operating the second valve to prevent fluid flow into and out of the second working chamber in the first range of depths; and operating the second valve to allow fluid flow into and out of the second working chamber in the second range of depths.

12. A method as recited in claim 11, further comprising the steps of:

turning the pump on and operating the first valve to prevent fluid flow between the pump and the accumulator to displace at least one of the first and second pistons in a first direction; and turning the pump off and operating the first valve to allow fluid flow between the first and second working chambers and the accumulator to displace at least one of the first and second pistons in a second direction.

13. A buoyancy control system for a submersible object comprising:

a housing fixed relative to the submersible object;

a first piston supported by the housing such that movement of the first piston changes a volume of a control chamber;

a second piston movably supported by the housing such that movement of the second piston changes the volume of the control chamber;

a source of pressurized working fluid; and first and second valves are operatively connected between the source of pressurized fluid and the first and second pistons to allow pressurized working fluid to displace at least one of the first and second pistons relative to the housing; wherein the buoyancy control system is operable in a shallow mode in a first range of depths and in a deep mode in a second range of depths;

in the shallow mode, the first and second valves are controlled to allow fluid to flow from the source of pressurized fluid to the first piston such that the pressurized fluid displaces the first piston to alter the volume of the control chamber and thus a buoyancy of the buoyancy control system; and in the deep mode, the first and second valves are controlled to allow fluid to flow from the source of pressurized fluid to the first and second pistons such that the pressurized fluid displaces both of the first and second pistons to alter the volume of the control chamber and thus the buoyancy of the buoyancy control system.

14. A buoyancy control system as recited in claim 13, in which:

the housing and the first and second pistons define a first working chamber and a second working chamber; and introduction of the working fluid into at least one of the first and second working chambers displaces at least one of the first and second pistons relative to the housing.

15. A buoyancy control system as recited in claim 13, in which:

the housing and the first and second pistons define a first working chamber and a second working chamber; and introduction of the working fluid into at least one of the first and second working chambers displaces at least one of the first and second pistons relative to the housing to alter the volume of the control chamber.

16. A buoyancy control system as recited in claim 13, in which:

the housing and the first and second pistons define an ambient chamber, a first working chamber, and a second working chamber; and introduction of the working fluid into at least one of the first and second working chambers displaces at least one of the first and second pistons relative to the housing to alter the volume of the control chamber and an amount of ambient fluid within the ambient chamber.

17. A buoyancy control system as recited in claim 13, further comprising:

first and second working chambers defined by the housing and the first and second pistons; and the source of pressurized fluid comprises an accumulator, and a pump connected to the first working chamber; whereby the first valve is connected between the pump and the accumulator;

the second valve is connected between the pump and the second working chamber;

in the shallow mode, the second valve is operated to prevent fluid flow into and out of the second working chamber; and in the deep mode, the second valve is operated to allow fluid flow into and out of the second working chamber.

18. A buoyancy control system as recited in claim 17, in which:

the pump is turned on and the first valve is operated to prevent fluid flow between the pump and the accumulator to displace at least one of the first and second pistons in a first direction; and the pump is turned off and the first valve is operated to allow fluid flow between the first and second working chambers and the accumulator to displace at least one of the first and second pistons in a second direction.

19. A buoyancy control system comprising:

a housing;

a first piston supported by the housing such that the first piston and the housing define a first working chamber, and movement of the first piston changes a volume of a control chamber;

a second piston supported by the housing such that the second piston and the housing define a second working chamber, and movement of the second piston changes the volume of the control chamber;

an accumulator;

a pump connected to the first working chamber;

a first valve connected between the pump and the accumulator; and a second valve connected between the pump and the second working chamber; whereby the buoyancy control system is operable in a shallow mode in a first range of depths and in a deep mode in a second range of depths;

in the shallow mode, displacement of the first piston alters a volume of the control chamber and thus a buoyancy of the buoyancy control system; and in the deep mode, displacement of the first and second pistons alters a volume of the control chamber and thus the buoyancy of the buoyancy control system.

20. A buoyancy control system as recited in claim 19, in which introduction of the working fluid into at least one of the first and second working chambers displaces at least one of the first and second pistons relative to the housing.

21. A buoyancy control system as recited in claim 19, in which:

the housing and the first and second pistons further define an ambient chamber; and introduction of the working fluid into at least one of the first and second working chambers displaces at least one of the first and second pistons relative to the housing to alter the volume of the control chamber and an amount of ambient fluid within the ambient chamber.

22. A buoyancy control system as recited in claim 19, in which:

the pump is turned on and the first valve is operated to prevent fluid flow between the pump and the accumulator to displace at least one of the first and second pistons in a first direction; and the pump is turned off and the first valve is operated to allow fluid flow between the first and second working chambers and the accumulator to displace at least one of the first and second pistons in a second direction.

23. A method of controlling buoyancy of a submersible object comprising the steps of:

arranging a housing within the submersible object;

arranging first and second pistons within the housing to define a control chamber;

supporting the first piston for movement within the housing such that the first piston and the housing define a first working chamber, and movement of the first piston changes a volume of the control chamber;

supporting a second piston for movement within the housing such that the second piston and the housing define a second working chamber, and movement of the second piston changes the volume of the control chamber;

connecting a pump to the first working chamber;

connecting a first valve between the pump and an accumulator;

connecting a second valve between the pump and the second working chamber;

operating the second valve to prevent fluid flow into and out of the second working chamber to displace the first piston to alter the volume of the control chamber and thus a buoyancy of the submersible object in a first range of depths; and operating the second valve to allow fluid flow into and out of the second working chamber to displace the first and second pistons to alter the volume of the control chamber and thus a buoyancy of the submersible object in a second range of depths.

24. A method as recited in claim 23, in which the steps of displacing the first and second pistons comprises the step of introducing working fluid into at least one of the first and second working chambers.

25. A method as recited in claim 23, in which:

the housing and the first and second pistons define a first working chamber and a second working chamber; and the steps of displacing the first and second pistons comprises the step of introducing working fluid into at least one of the first and second working chambers to displace at least one of the first and second pistons and thereby alter the volume of the control chamber.

26. A method as recited in claim 23, in which:

the housing and the first and second pistons define an ambient chamber, a first working chamber, and a second working chamber; and the steps of displacing the first and second pistons comprises the step of introducing working fluid into at least one of the first and second working chambers to displace at least one of the first and second pistons and thereby alter the volume of the control chamber and an amount of ambient fluid within the ambient chamber.

27. A method as recited in claim 23, further comprising the steps of:

turning the pump on and operating the first valve to prevent fluid flow between the pump and the accumulator to displace at least one of the first and second pistons in a first direction; and turning the pump off and operating the first valve to allow fluid flow between the first and second working chambers and the accumulator to displace at least one of the first and second pistons in a second direction.

28. A buoyancy control system for a submersible object comprising:

a housing fixed relative to the submersible object;

a first piston supported by the housing such that the first piston and the housing define a first working chamber, and movement of the first piston changes a volume of a control chamber;

a second piston supported by the housing such that the second piston and the housing define a second working chamber, and movement of the second piston changes the volume of the control chamber;

an accumulator;

a pump connected to the first working chamber;

a first valve connected between the pump and the accumulator; and a second valve connected between the pump and the second working chamber; whereby the buoyancy control system is operable in a shallow mode in a first range of depths and in a deep mode in a second range of depths;

in the shallow mode, displacement of the first piston alters the volume of the control chamber and thus the buoyancy of the buoyancy control system; and in the deep mode, displacement of the first and second pistons alters the volume of the control chamber and thus the buoyancy of the buoyancy control system.

29. A buoyancy control system as recited in claim 28, in which introduction of the working fluid into at least one of the first and second working chambers displaces at least one of the first and second pistons relative to the housing.

30. A buoyancy control system as recited in claim 28, in which:

the housing and the first and second pistons further define an ambient chamber; and introduction of the working fluid into at least one of the first and second working chambers displaces at least one of the first and second pistons relative to the housing to alter the volume of the control chamber and an amount of ambient fluid within the ambient chamber.

31. A buoyancy control system as recited in claim 28, in which:

the pump is turned on and the first valve is operated to prevent fluid flow between the pump and the accumulator to displace at least one of the first and second pistons in a first direction; and the pump is turned off and the first valve is operated to allow fluid flow between the first and second working chambers and the accumulator to displace at least one of the first and second pistons in a second direction.

* * * * *